United States Patent [19]

Haikkala

[11] 4,333,613

[45] Jun. 8, 1982

[54] APPARATUS FOR CONTINUOUSLY GRINDING WOOD UNDER PRESSURE AND CONTINUOUSLY DISCHARGING GROUNDWOOD

[75] Inventor: Pekka O. Haikkala, Vuolteenkatu, Finland

[73] Assignee: Oy. Tampella AB, Tampere, Finland

[21] Appl. No.: 211,867

[22] Filed: Dec. 1, 1980

Related U.S. Application Data

[62] Division of Ser. No. 6,156, Jan. 24, 1979, Pat. No. 4,274,600.

[30] Foreign Application Priority Data

Feb. 16, 1978 [FI] Finland ..... 780514

[51] Int. Cl.[3] ..... B02C 23/24

[52] U.S. Cl. ..... 241/34; 241/57; 241/152 A; 241/280; 241/DIG. 14

[58] Field of Search ..... 241/18, 28, 34, 33, 241/152 A, 280, 281, 57, 282, DIG. 14

[56] References Cited

U.S. PATENT DOCUMENTS 3,808,090 4/1974 Logan ..... 241/28 X 4,235,665 11/1980 Reinhall ..... 241/28 X 4,236,959 12/1980 Reinhall ..... 241/18 X

*Primary Examiner*—Mark Rosenbaum

*Assistant Examiner*—Timothy V. Eley

*Attorney, Agent, or Firm*—Ladas & Parry

[57] ABSTRACT

Apparatus for continuously processing wood comprises a pressurized grinding chamber, a grinding stone which is mounted for rotation in the grinding chamber, a device for feeding wood into the grinding chamber to form a primary groundwood stock therein, and a device for discharging the primary groundwood stock from the chamber without allowing gas to escape from the chamber to atmosphere. The feeding device comprises a stationary feeding chamber provided with shutters for sequentially pressure-tightly closing the feeding chamber from the atmosphere and from the grinding chamber respectively, thereby to prevent escape of gas from the grinding chamber through the feeding device. The discharging device comprises a stick crusher for crushing sticks present in the primary groundwood stock thereby to produce a secondary groundwood stock and an outlet for continuously discharging the secondary groundwood stock while preserving a hydraulic seal of groundwood stock thereby to prevent escape of gas from the grinding chamber through the discharging device.

7 Claims, 1 Drawing Figure

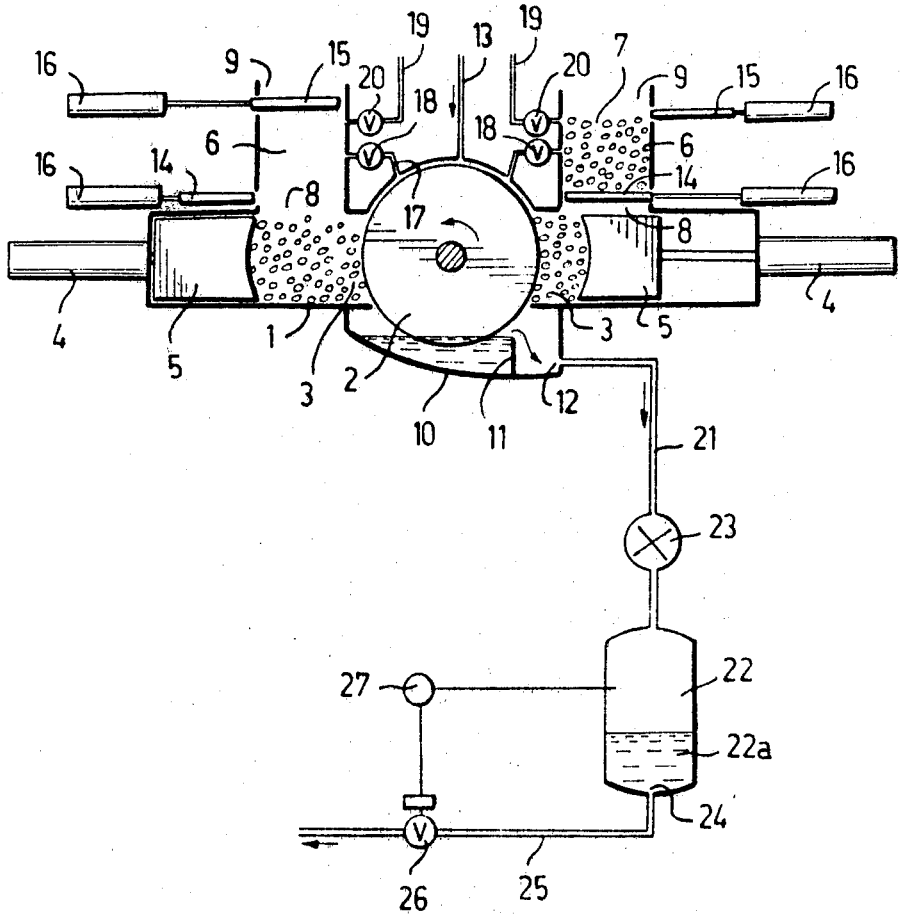
16
9
15
19
13
19
7
9
15
16
20
18
20
18
6
6
16
14
14
16
8
17
8
4
5
1
3
2
10
11
12
3
5
4
21
23
22
27
22a
24
26
25

APPARATUS FOR CONTINUOUSLY GRINDING WOOD UNDER PRESSURE AND CONTINUOUSLY DISCHARGING GROUNDWOOD

This is a divisional of co-pending application Ser. No. 006,156 filed Jan. 24, 1979, now U.S. Pat No. 4,274,600 issued June 23, 1981.

The present invention relates to apparatus for grinding wood under pressurized conditions in a grinder comprising a pressurized gas-filled grinding chamber for a rotating grinding means, and in which wood is fed in batches into said grinding chamber, the fed wood batch is pressed against said grinding means and the formed groundwood stock is discharged from said grinding chamber.

It is well known to grind wood in batches by pressing a wood batch by means of a pressing element against a rotating grinding stone while simultaneously feeding shower water into the grinding chamber. By means of a dam the formed groundwood stock level is kept in the grinding chamber a little higher than the lower surface of the stone in order to clean, lubricate and cool the stone. The groundwood stock flowing over the dam has been discharged by its own weight from the grinding chamber for further treatment.

It is also known, for example from U.S. Pat. Nos. 3,808,090 and 3,948,449 that the groundwood can be improved by grinding wood in a closed grinding chamber in a pressurized gaseous atmosphere. The gas consists of air, steam or an inert gas, and the overpressure of the gas may rise up to about 1.4–2.8 bar. In the grinder described in said patents wood is fed batchwise and the pressurized gaseous atmosphere of the grinding chamber can be maintained only as long as the grinding of a wood batch continues but as soon as a new wood batch is fed into the magazine the pressure in the grinding becomes atmospheric. Thus the grinder cannot work with a continuously pressurized atmosphere in the grinding chamber.

Because the material to be fed into the grinder consists of blocks of wood, it is not possible to use any rotary valves or corresponding pressure preserving feeding devices which are generally used when feeding e.g. wood chips into pressurized digesters, disc refiners or the like. Therefore difficulties have arisen when trying to feed wood into the grinding chamber and to discharge the groundwood stock from the grinding chamber without allowing the pressure in the grinding chamber to drop.

The object of the present invention is to eliminate these said disadvantages and make it possible to both feed the wood and discharge the groundwood stock without harmfully affecting the pressurized gaseous atmosphere in the grinding chamber. This object is achieved by means of an apparatus according to the invention, wherein the batches of wood are fed into the pressurized gas-filled grinding chamber through a stationary feeding chamber, which can be sequentially pressure-tightly closed from the atmosphere and from the grinding chamber respectively by shutters, and the groundwood is discharged through a discharging device which comprises a tank for the groundwood stock which forms a pressure lock between the grinding chamber and the atmosphere.

In the following the invention will be described in more detail with reference to the enclosed drawing which is a diagrammatic view of an embodiment of a grinder according to the invention.

The grinder shown in the drawing comprises a frame 1 and a grinding stone 2 which is rotatably mounted in the frame. On both sides of the grinding stone there is a pressure-tight grinding chamber 3. In each grinding chamber a pressure shoe 5 is provided which is displaceable by means of a hydraulic cylinder 4. Above each grinding chamber a vertical feeding chamber 6 is provided for a wood batch 7 to be fed into the grinding chamber. The feeding chamber has a lower opening 8 communicating with the grinding chamber and an upper opening 9 communicating with the atmosphere. Below the grinding, stone the frame forms a pit 10 which is provided with an overflow 11 and an outflow 12. Shower water is fed on the grinding stone by nozzles which are not shown. A grinder of the type described above is known per se, and therefore it will not be further described. The grinder is further provided with a feed pipe 13 for pressurized gas in order to subject the grinding chambers to an adjustable pressure.

According to the invention, the lower and upper openings of each feeding chamber are pressure-tightly sealed by means of parallel shutters 14,15 which are displaced by hydraulic cylinders 16. Thus the feeding chamber and the shutters form a pressure-tight sluice. The feeding chamber is connected to the grinding chamber through a pipe 17 which can be closed or opened by means of a valve 18, and to the atmosphere through a pipe 19 which can be closed or opened by means of a valve 20.

According to the invention the outflow 12 of the grinder is connected through a pipe 21 to a pressure-tight tank 22. Said pipe 21 is provided with a stick crusher positioned between the grinding chamber 3 and a control valve 26, in this case between the grinding chamber and the tank 22. At the bottom of the tank there is an outflow 24 which is connected to an outflow pipe 25 which can be closed and opened by means of a valve 26. The operation of the valve is controlled by means of a pressure difference detector 27, which detects the height of the groundwood stock in the tank.

The grinder operates as follows:

A wood batch is pressed by the pressure shoe 5 against the grinding stone in the right-hand grinding chamber of the grinder. A new wood batch has been brought into the feeding chamber 6, whereby the lower shutter 14 of the chamber is pressure-tightly closed and the upper shutter 15 is open. The valve 18 in the pipe to the grinding chamber is closed. The same applies to the valve 20 to the atmosphere. When the feeding chamber is filled the upper shutter is pressure-tightly closed. Thereafter the valve 18 in the pipe to the grinding chamber is opened so that the pressure in the feeding chamber becomes the same as the pressure in the grinding chamber. When the wood batch in the grinding chamber has been ground and the pressure shoe has been displaced to its receiving position the lower shutter 14 is opened so that the new wood batch falls from the feeding chamber into the grinding chamber as shown in the left-hand part of the grinder. Thereafter the lower shutter 14 and the valve 18 are closed and the valve 20 to the atmosphere is opened, whereby the pressure in the feeding chamber becomes atmospheric. The upper shutter 15 can now be opened and a new wood batch can be brought into the feeding chamber.

When a wood batch is fed from the feeding chamber into the grinding camber, also relatively cold air flows into the grinding chamber at the same time. The temperature in the grinding chamber is generally kept above 100° C. and therefore the cold air flowing into the grinding chamber expands and thereby increases the pressure in the grinding chamber. Excessive air can be discharged from the grinding chamber by means of a pressure-balancing valve (not shown) in order to keep the pressure in the grinding chamber at a desired level. Also pressure drops in the grinding chamber caused by leakage can thus be compensated by the pressurized air flowing in from the feeding chamber.

It is observed that the above-described feeding system makes it possible to feed wood into a grinding chamber in which there is a continuous pressurized atmosphere and to maintain the desired overpressure in the grinding chamber at the same time.

The groundwood stock is collected in the pit 10 of the grinder and forms in the pit a damm of groundwood stock with a consistency of 0.8–4%. This stock generally contains sticks, chips and pieces of wood which have passed the grinding process. The surface of the damm is about 2–10 cm higher than the lower surface of the grinding stone. The suspension flows over the overflow 11 and by its own weight further to the stick crusher 23 in which the sticks, chips and pieces of wood which passed the grinding process are crushed into smaller pieces in order to prevent choking of the valve 26. From the crusher the groundwood stock flows into the tank 22, the interior of which is under the same pressure as the grinding chambers, for example 0.8–3.0 bar. This pressure tends to force the groundwood stock from the tank through the outlet pipe 25 but the outflow of stock is controlled by the valve 26 and the pressure difference detector 27 so that the surface of the groundwood stock 22*a* in the tank is always at a preset level above the outlet of the tank. This layer in the tank prevents the pressure from disappearing from the grinding chamber.

It is observed that the described discharge system makes it possible to discharge groundwood stock from a pressurized grinding chamber to atmospheric pressure and to maintain the desired overpressure in the grinding chamber at the same time. Together with the earlier described feeding system it is possible to obtain a continuously working pressure grinder.

The object of the drawing and the description is only to illustrate the idea of the invention. In details the grinder can vary considerably within the scope of the claims.

What I claim is:

1. Apparatus for continuously processing wood, comprising means defining a grinding chamber, means for providing gas under superatmospheric pressure in the grinding chamber, a grinding means which is mounted for rotation in the grinding chamber, a device for feeding wood into the grinding chamber to form a primary groundwood stock therein, and a device for discharging the primary groundwood stock from the chamber without allowing gas to escape from the grinding chamber to atmosphere, the feeding device comprising a stationary feeding chamber provided with shutter means for sequentially pressure-tightly closing said feeding chamber from the atmosphere and from the grinding chamber respectively, thereby to prevent escape of gas from the grinding chamber through the feeding device, and the discharging device comprising a stick crusher for crushing sticks present in the primary groundwood stock thereby to produce a secondary groundwood stock, and means for receiving the secondary groundwood stock from the stick crusher and for continuously discharging the secondary groundwood stock while preserving a hydraulic seal of groundwood stock thereby to prevent escape of gas from the grinding chamber through the discharge device.

2. Apparatus according to claim 1, wherein the means for receiving secondary groundwood stock from the stick crusher comprise a tank having an outlet opening for discharging groundwood stock, the tank being providing with means for maintaining the level of groundwood stock in the tank above the outlet opening, thereby to maintain a hydraulic seal of groundwood stock and prevent discharge of pressurized gas from the grinding chamber by way of said outlet opening.

3. Apparatus according to claim 2, wherein the means for maintaining the level of groundwood stock in the tank above the outlet opening comprise a valve for adjusting the flow of groundwood stock through said outlet opening.

4. Apparatus according to claim 3, wherein the means for maintaining the level of groundwood stock in the tank above the outlet opening further comprise means for detecting the level of the groundwood stock in the tank and controlling operation of the valve to maintain the surface of the stock at a preset level above said outlet opening.

5. Apparatus according to claim 1, wherein the feeding chamber is provided with first and second connections to the atmosphere and to the grinding chamber respectively, and said shutter means comprises a first shutter for opening and closing said first connection, a second shutter for opening and closing said second connection, and operating devices for moving the respective shutters between their open and closed positions.

6. Apparatus according to claim 1 or 5, comprising pressure adjusting means for adjusting the pressure in the feeding chamber.

7. Apparatus according to claim 1, comprising a second feeding device which comprises a stationary feeding chamber provided with shutter means for sequentially pressure-tightly closing the feeding chamber of said second feeding device from the atmosphere and from the grinding chamber respectively, whereby successive batches of wood can be fed into the grinding chamber through the different feeding devices respectively.

* * * * *